US010141132B1

(12) United States Patent
Tseng et al.

(10) Patent No.: US 10,141,132 B1
(45) Date of Patent: Nov. 27, 2018

(54) DUAL-ACTUATOR SWITCH

(71) Applicants: SOLTEAM ELECTRONICS (DONG GUAN) CO., LTD., Dong Guan (CN); SOLTEAM ELECTRONICS (SU ZHOU) CO., LTD., Wu Jiang (CN); SOLTEAM ELECTRONICS CO., LTD., Taoyuan (TW)

(72) Inventors: Kuo-Jui Tseng, Taoyuan (TW); Chi-Meng Phang, Taoyuan (TW); Chien-Man Chen, Taoyuan (TW)

(73) Assignees: SOLTEAM ELECTRONICS (DONG GUAN) CO., LTD. (CN); SOLTEAM ELECTRONICS (SU ZHOU) CO., LTD. (CN); SOLTEAM ELECTRONICS CO., LTD. (TW)

( * ) Notice: Subject to any disclaimer, the term of this patent is extended or adjusted under 35 U.S.C. 154(b) by 0 days.

(21) Appl. No.: 15/854,749

(22) Filed: Dec. 27, 2017

(51) Int. Cl.
*H01H 13/14* (2006.01)
*H01H 13/10* (2006.01)

(52) U.S. Cl.
CPC ..... *H01H 13/10* (2013.01); *H01H 13/14* (2013.01); *H01H 2235/01* (2013.01)

(58) Field of Classification Search
CPC ..... H01H 13/14; H01H 13/02; H01H 13/70; H01H 13/76
See application file for complete search history.

(56) References Cited

U.S. PATENT DOCUMENTS 5,406,277 A * 4/1995 Lee ..... B41J 5/12 200/345
5,646,382 A * 7/1997 Moriya ..... H01H 13/72 200/5 E
7,538,285 B2 * 5/2009 Patel ..... H01H 13/705 200/314
10,026,569 B2 * 7/2018 Danowski ..... H01H 13/70
10,056,202 B2 * 8/2018 Naka ..... H01H 13/18

* cited by examiner

*Primary Examiner* — Vanessa Girardi

(57) ABSTRACT

The present invention discloses a dual-actuator switch, comprising: a base, a first electrical connection member, a second electrical connection member, a first isolation sleeve cylinder, a second isolation sleeve cylinder, a first actuator, a second actuator, and a cover. By pressing one of the two actuators to drive one of the two isolation sleeve cylinders to rotate, the isolation sleeve cylinder is driven to prop one of the two electrical connection members by a protrusion member thereof, such that one of two switching operations is carried out. It is worth noting that, the electrical connection members are isolated from the actuators by the isolation sleeve cylinders during the whole electrical switching procedures. As a result, ambient moisture is absolutely blocked from getting into the base for infiltrating the electrical connection members during the up and/or down motion of the actuators.

7 Claims, 11 Drawing Sheets

DUAL-ACTUATOR SWITCH

BACKGROUND OF THE INVENTION

1. Field of the Invention

The present invention relates to the technology field of switch mechanisms, and more particularly to a dual-actuator switch.

2. Description of the Prior Art

Push-type switches have been widely used in various electrical products, such as industrial controllers, electrical controllers in vehicles, and trigger circuits for security equipment. Conventional push-type switch is often provided with an actuator, such that it is able to turn ON or OFF the electrical product by applying a pressing force to the actuator of the push-type switch.

FIG. 1 shows a cross-sectional view of one kind of conventional push-type switch. As FIG. 1 shows, the conventional push-type switch 1' comprises: two actuators 10', two return springs 12', a supporting members 13', and a first electrical connection member 14'. From FIG. 1, it is found that each of the two actuators 10' is provided with a second electrical connection member 11', and the two return springs 12' are connected to the bottom end of the two actuators 10', respectively. On the other hand, the first electrical connection member 14' is disposed on the supporting member 13' for connecting the second electrical connection member 11'. By such arrangement, it is able to release the connection between the second electrical connection member 11' and the first electrical connection member 14' by applying a pressing force to any one of the two actuators 10'.

Despite of the fact that the push-type switch 1' shown as FIG. 1 has been widely used in various electrical products, inventors of the present invention find that the push-type switch 1' still exhibits following drawback in practical use:

(1) owing to the fact that the first and second electrical connection members (14', 11') are made of metal materials, ambient moisture may get into the internal of the push-type switch 1' n the case of applying a pressing force to any one of the two actuators 10'. As a result, the invading moisture may infiltrate the first and second electrical connection members (14', 11'), so as to form a short circuit between the two electrical connection members (14', 11').

From above descriptions, it is understood that how to design and manufacture a push-type switch with moisture proof function has become an important issue. In view of that, the inventor of the present application has made great efforts to make inventive research thereon and eventually provided a dual-actuator switch.

SUMMARY OF THE INVENTION

The primary objective of the present invention is to provide a dual-actuator switch, comprising: a base, a first electrical connection member, a second electrical connection member, a first isolation sleeve cylinder, a second isolation sleeve cylinder, a first actuator, a second actuator, and a cover. By pressing the first actuator to drive the first isolation sleeve cylinder to rotate, a protrusion member of the first isolation sleeve cylinder is driven to prop the first electrical connection member, such that a first switching operation is carried out. By the same way, it is able to achieve a second switching operation through making a protrusion member of the second isolation sleeve cylinder to prop the second electrical connection member by pressing the second actuator. It is worth noting that, the electrical connection members are isolated from the actuators by the isolation sleeve cylinders during the whole electrical switching procedures. As a result, ambient moisture is absolutely blocked from getting into the base for infiltrating the electrical connection members during the up and/or down motion of the actuators.

In order to achieve the primary objective of the present invention, the inventor of the present invention provides an embodiment for the dual-actuator switch, comprising:

a base, having an accommodating space;

a first electrical connection member, disposed in the accommodating space and having a first electrical terminal and a second electrical terminal;

a second electrical connection member, disposed in the accommodating space for facing the first electrical connection member, and having a third electrical terminal and a fourth electrical terminal for respectively connecting the first electrical terminal and the second electrical terminal;

a first isolation sleeve cylinder, disposed in the accommodating space and provided with a first protrusion member on the outer wall thereof;

a second isolation sleeve cylinder, disposed in the accommodating space and provided with a second protrusion member on the outer wall thereof;

a first return spring, disposed in the first isolation sleeve cylinder;

a first post-shaped actuator, disposed in the first isolation sleeve cylinder and connecting with the first return spring;

a second return spring, disposed in the second isolation sleeve cylinder;

a second post-shaped actuator, disposed in the second isolation sleeve cylinder and connecting with the second return spring; and a cover, assembled with the base for sheltering the accommodating space, and having two openings;

wherein a first pressing portion of the first post-shaped actuator and a second pressing portion of the second post-shaped actuator are extended out of the cover via the two openings.

BRIEF DESCRIPTION OF THE DRAWINGS

The invention as well as a preferred mode of use and advantages thereof will be best understood by referring to the following detailed description of an illustrative embodiment in conjunction with the accompanying drawings, wherein.

DETAILED DESCRIPTION OF THE PREFERRED EMBODIMENTS

To more clearly describe a dual-actuator switch disclosed by the present invention, embodiments of the present invention will be described in detail with reference to the attached drawings hereinafter.

Figure 1:
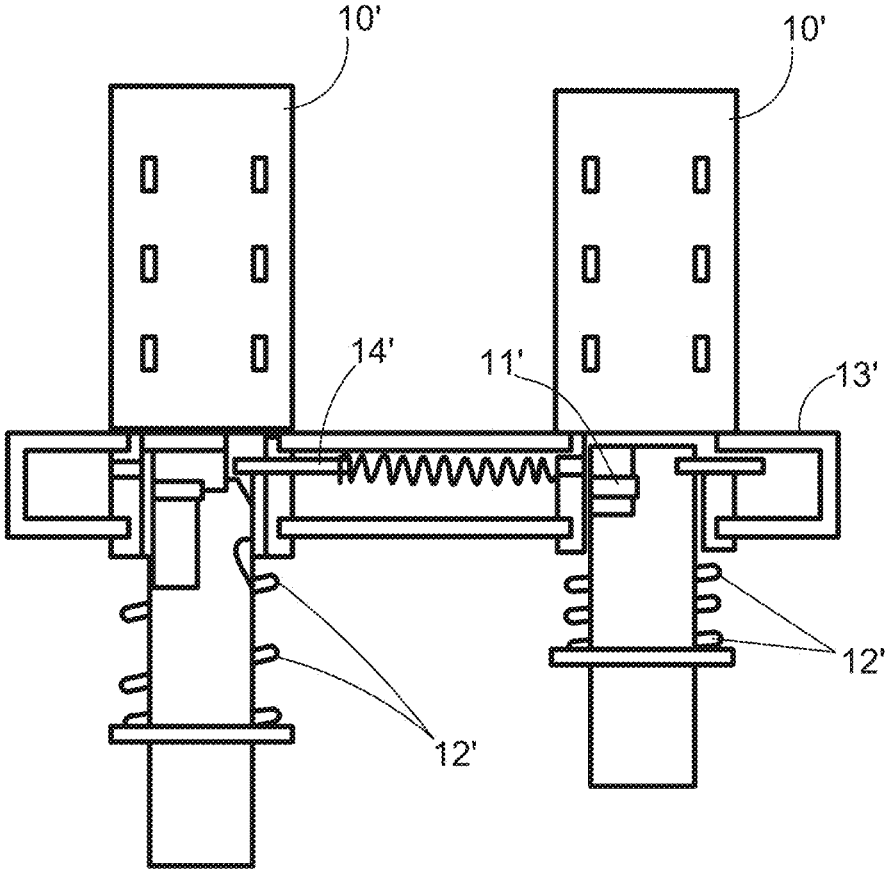
FIG. 1 (prior art)
FIG. 1 shows a cross-sectional view of one kind of conventional push-type switch.
Figure 2:
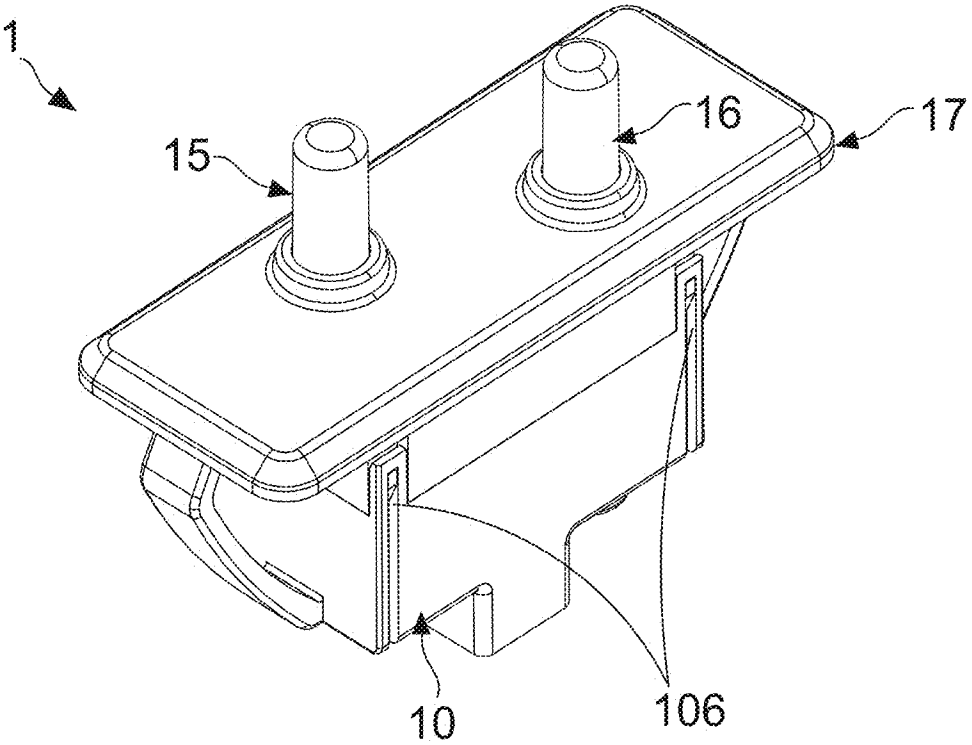
FIG. 2 and FIG. 3 show stereo diagrams of a dual-actuator switch according to the invention.
Figure 3:
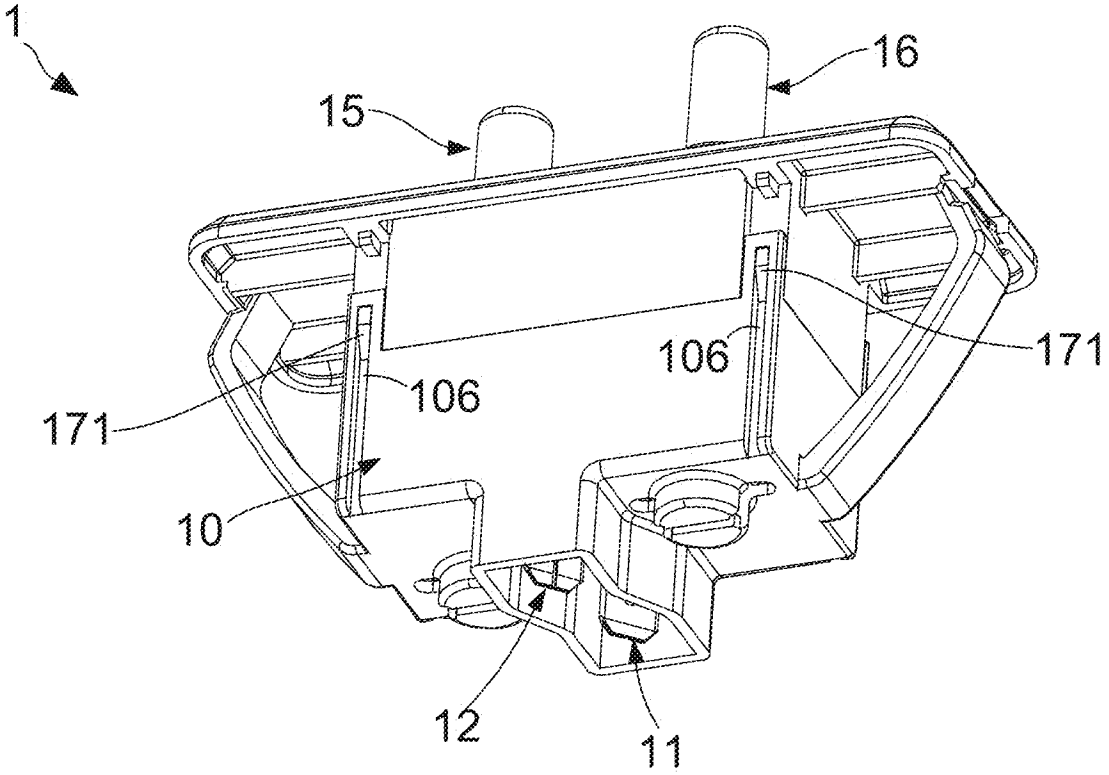
Figure 4:
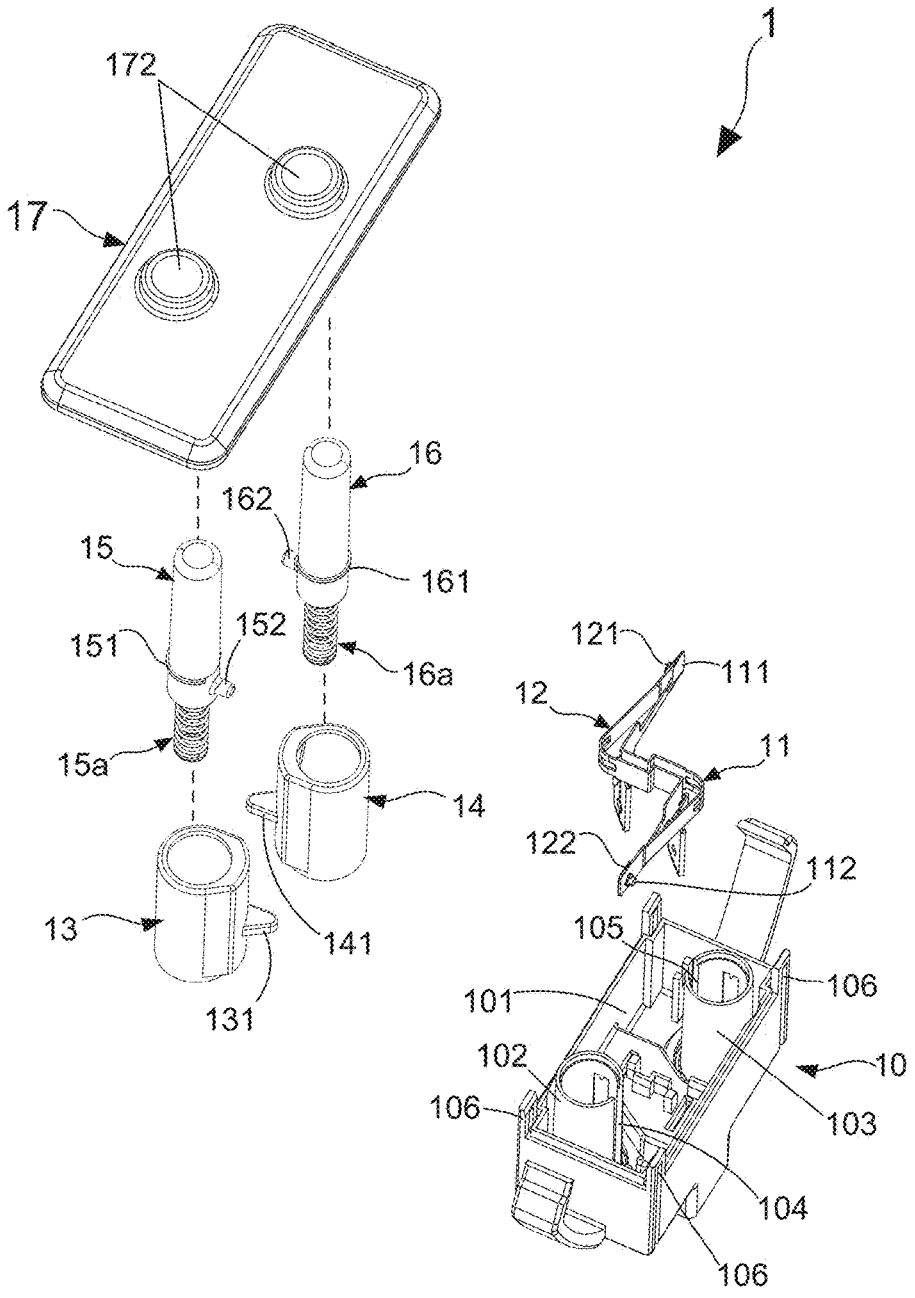
FIG. 4 and FIG. 5 show stereo exploded diagrams of a dual-actuator switch according to the invention.
Figure 5:
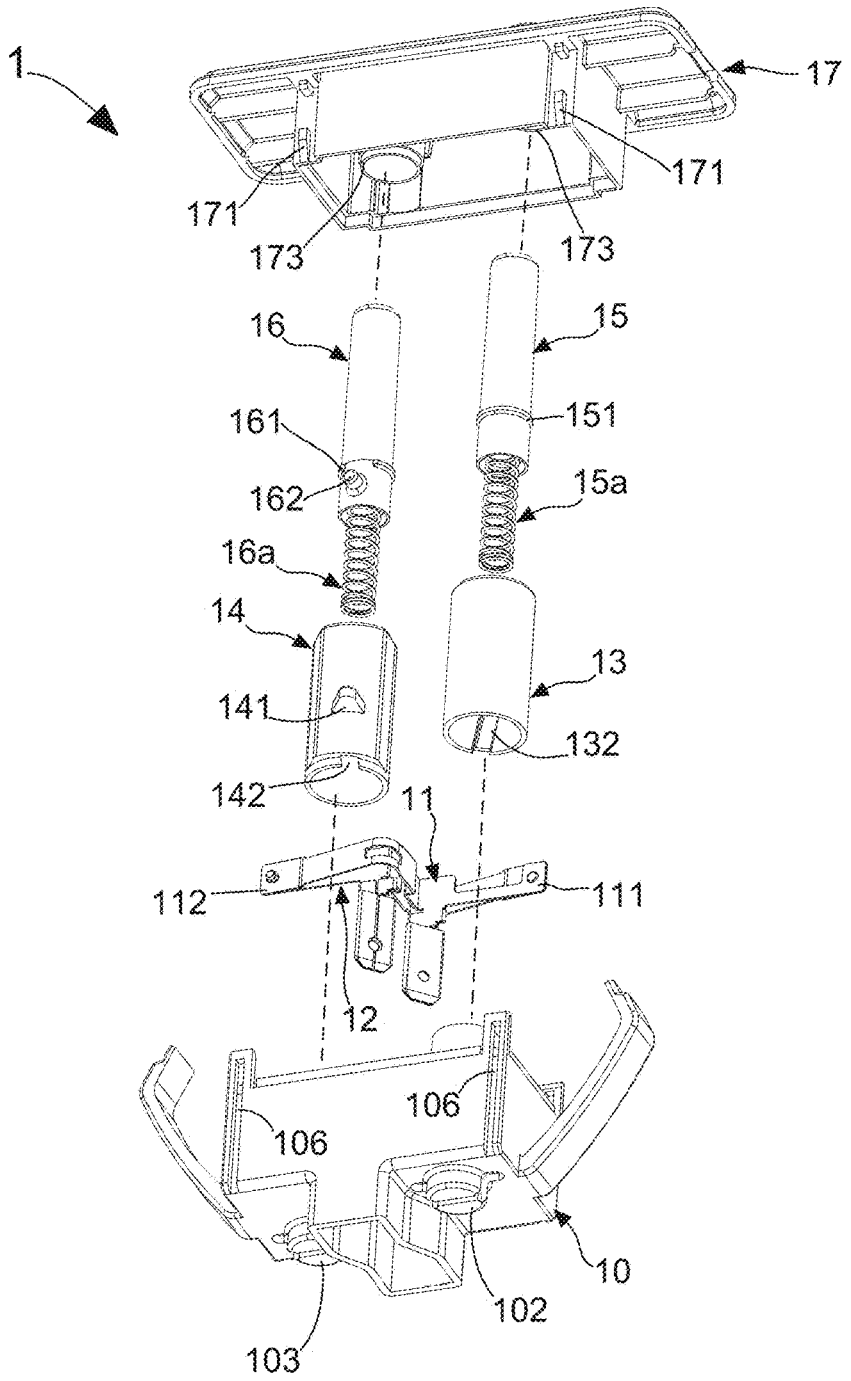

Please refer to FIG. 2, FIG. 3, FIG. 4, and FIG. 5, wherein FIG. 2 and FIG. 3 show stereo diagrams of a dual-actuator switch according to the invention, and FIG. 4 and FIG. 5 show stereo exploded diagrams of a dual-actuator switch according to the invention. The dual-actuator switch 1 of the present invention comprises: a base 10, a first electrical connection member 11, a second electrical connection member 12, a first isolation sleeve cylinder 13, a second isolation sleeve cylinder 14, a first return spring 15*a*, a first post-shaped actuator 15, a second return spring 16*a*, a second post-shaped actuator 16, and a cover 17. From FIG. 2 and FIG. 4, it is understood that the base 10 having an accommodating space 101 and the cover 17 form the housing body of the dual-actuator switch 1; moreover, a first pressing portion of the first post-shaped actuator 15 and a second pressing portion of the second post-shaped actuator 16 are extended out of the cover 17 via two openings 172.

Figure 6:
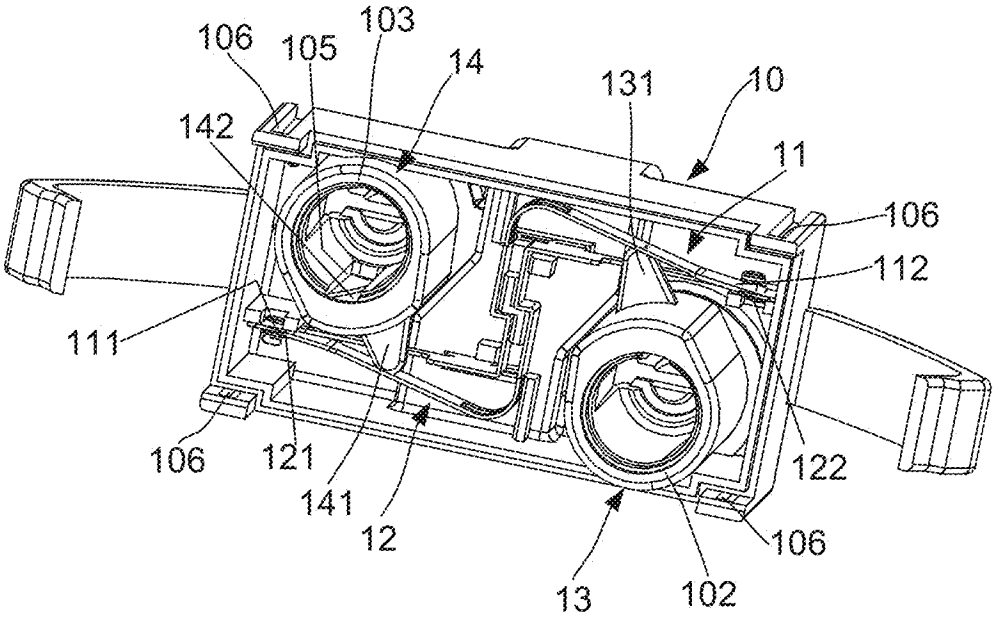
FIG. 6 shows a stereo diagram for depicting a base, a first electrical connection member, a second electrical connection member, a first isolation sleeve cylinder, and a second isolation sleeve cylinder of the dual-actuator switch.

Continuously referring to FIG. 2-FIG. 5, and please simultaneously refer to FIG. 6, which illustrates a stereo diagram for depicting the base, the first electrical connection member, the second electrical connection member, the first isolation sleeve cylinder, and the second isolation sleeve cylinder of the dual-actuator switch. According to the presented diagrams, it is known that the first isolation sleeve cylinder 13 is disposed in the accommodating space 101 and provided with a first protrusion member 131 on the outer wall thereof. Similarly, the second isolation sleeve cylinder 14 is disposed in the accommodating space 101 and provided with a second protrusion member 141 on the outer wall thereof. Particularly, a first slant groove 132 is formed on the inner wall of the first isolation sleeve cylinder 13, and a second slant groove 142 is formed on the inner wall of the second isolation sleeve cylinder 14.

On the other hand, a first sleeve cylinder 102 and a second sleeve cylinder 103 are formed in the accommodating space 101 of the base 10. From FIG. 2, it is understood that the first sleeve cylinder 102 is used for receiving the first isolation sleeve cylinder 13, and provide with a first slide groove 104 on the outer wall thereof. Moreover, the second sleeve cylinder 103 is used for receiving the second isolation sleeve cylinder 14, and provide with a second slide groove 105 on the outer wall thereof. In addition, FIG. 4, FIG. 5 and FIG. 6 depict that the first electrical connection member 11 is disposed in the accommodating space 101 and has a first electrical terminal 111 and a second electrical terminal 112. Moreover, the second electrical connection member 12 is also disposed in the accommodating space 101 for facing the first electrical connection member 11, and has a third electrical terminal 121 and a fourth electrical terminal 122 for respectively connecting the first electrical terminal 111 and the second electrical terminal 112.

Figure 7:
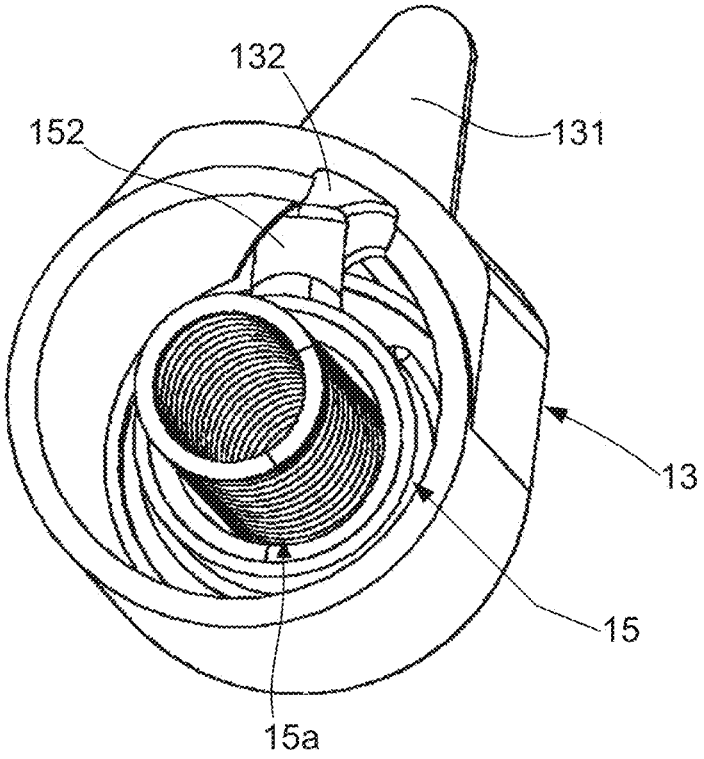
FIG. 7 shows a stereo diagram for depicting the first isolation sleeve cylinder and a first post-shaped actuator of the dual-actuator switch.
Figure 8:
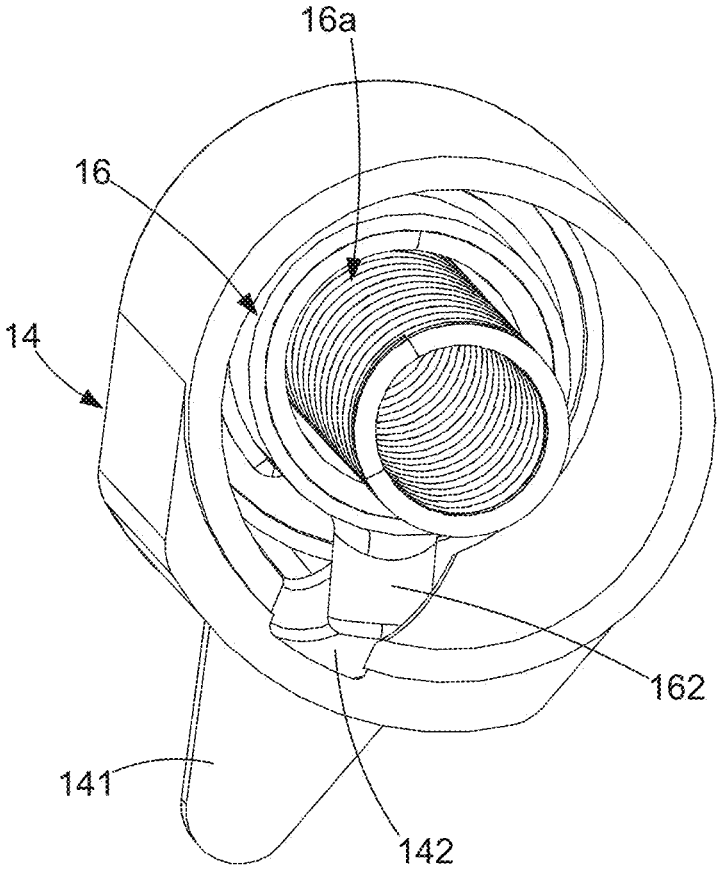
FIG. 8 shows a stereo diagram for depicting the second isolation sleeve cylinder and a second post-shaped actuator of the dual-actuator switch.
Figure 9:
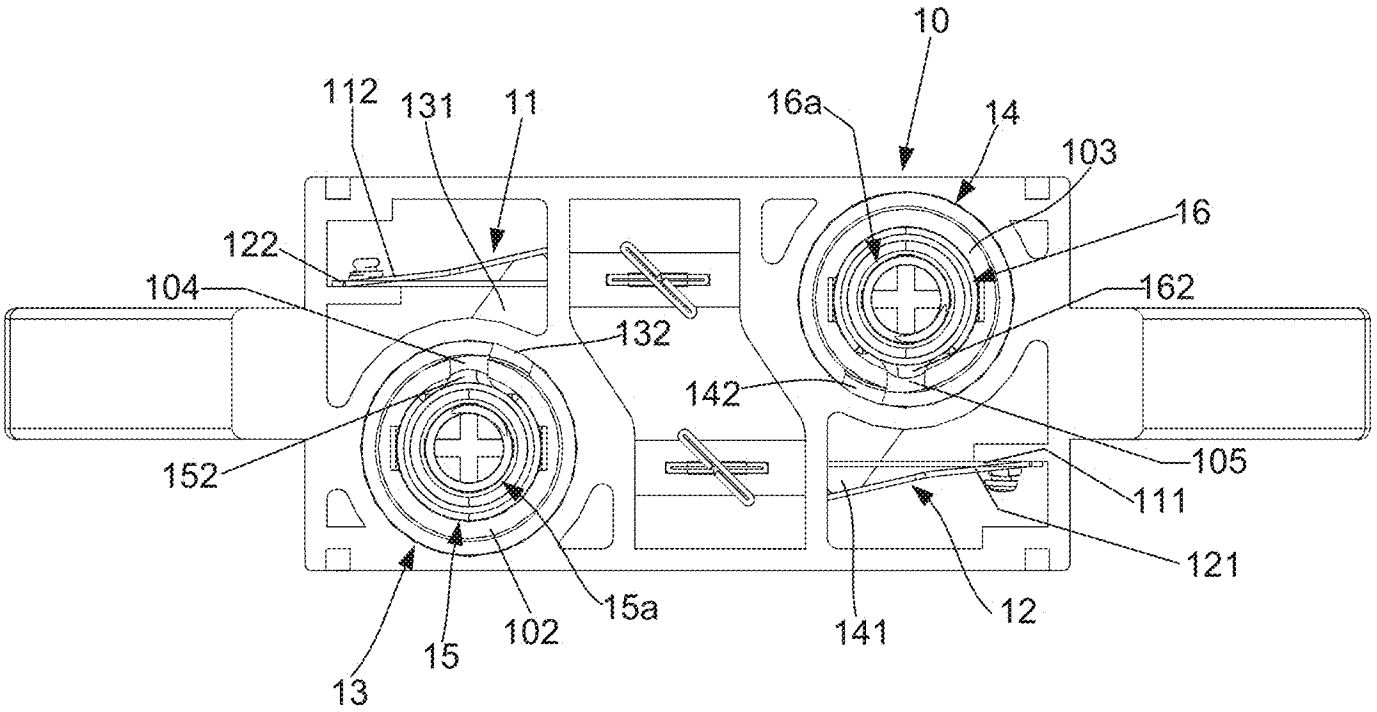
FIG. 9 shows a cross-sectional view of the dual-actuator switch.

Continuously referring to FIG. 2-FIG. 6, and please simultaneously refer to FIG. 7, FIG. 8 and FIG. 9. It needs to explain that, FIG. 7 provides a stereo diagram for depicting the first isolation sleeve cylinder and the first post-shaped actuator of the dual-actuator switch, FIG. 8 shows a stereo diagram for depicting the second isolation sleeve cylinder and the second post-shaped actuator of the dual-actuator switch, and FIG. 9 is a cross-sectional diagram of the dual-actuator switch. In the present invention, the first return spring 15*a* is disposed in the first isolation sleeve cylinder 13, and the first post-shaped actuator 15 is disposed in the first isolation sleeve cylinder 13 and connects with the first return spring 15*a*. On the other hand, the second return spring 16*a* is disposed in the second isolation sleeve cylinder 14, and the second post-shaped actuator 16 is disposed in the second isolation sleeve cylinder 14 and connects with the second return spring 16*a*.

According to the particular design of the present invention, the first post-shaped actuator 15 further comprises a first position limiting flange 151 and a first position limiting protrusion member 152, wherein the first position limiting flange 151 is formed on the outer wall of the first post-shaped actuator 15, and the first position limiting protrusion member 152 is formed on the outer wall of the first post-shaped actuator 15. Herein it needs to explain how to carry out a first switching operation by pressing the first post-shaped actuator 15. After one pressing force is applying to the first pressing portion of the first post-shaped actuator 15, the first position limiting protrusion member 152 slide in the first slide groove 103 and the first slant groove 132 under the position limitation provided by the first position limiting flange 151 and the inner wall of the first isolation sleeve cylinder 13. In the meantime, the first isolation sleeve cylinder 13 is driven to rotate due to the sliding motion of the first position limiting protrusion member 152 in the first slant groove 132. It is worth noting that, the rotation of the first isolation sleeve cylinder 13 is limited in the case of that the first protrusion member 131 props a first contact section of the first electrical connection member 11 between the first electrical terminal 111 and the second electrical terminal 112.

The same as the structure design as the first post-shaped actuator 15, the second post-shaped actuator 16 also further comprises a second position limiting flange 161 and a second position limiting protrusion member 162, wherein the second position limiting flange 161 is formed on the outer wall of the second post-shaped actuator 16, and the second position limiting protrusion member 162 is formed on the outer wall of the second post-shaped actuator 16. Herein it needs to explain how to carry out a second switching operation by pressing the second post-shaped actuator 16. After one pressing force is applying to the second pressing portion of the second post-shaped actuator 16, the second position limiting protrusion member 162 slides in the second slide groove 104 and the second slant groove 142 under the position limitation provided by the second position limiting flange 161 and the inner wall of the second isolation sleeve cylinder 14. In the meantime, the second isolation sleeve cylinder 14 is driven to rotate due to the sliding motion of the second position limiting protrusion member 162 in the second slant groove 142. It is worth noting that, the rotation of the second isolation sleeve cylinder 14 is limited in the case of that the second protrusion member 141 props a second contact section of the second electrical connection member 12 between the third electrical terminal 121 and the fourth electrical terminal 122.

Figure 10A:
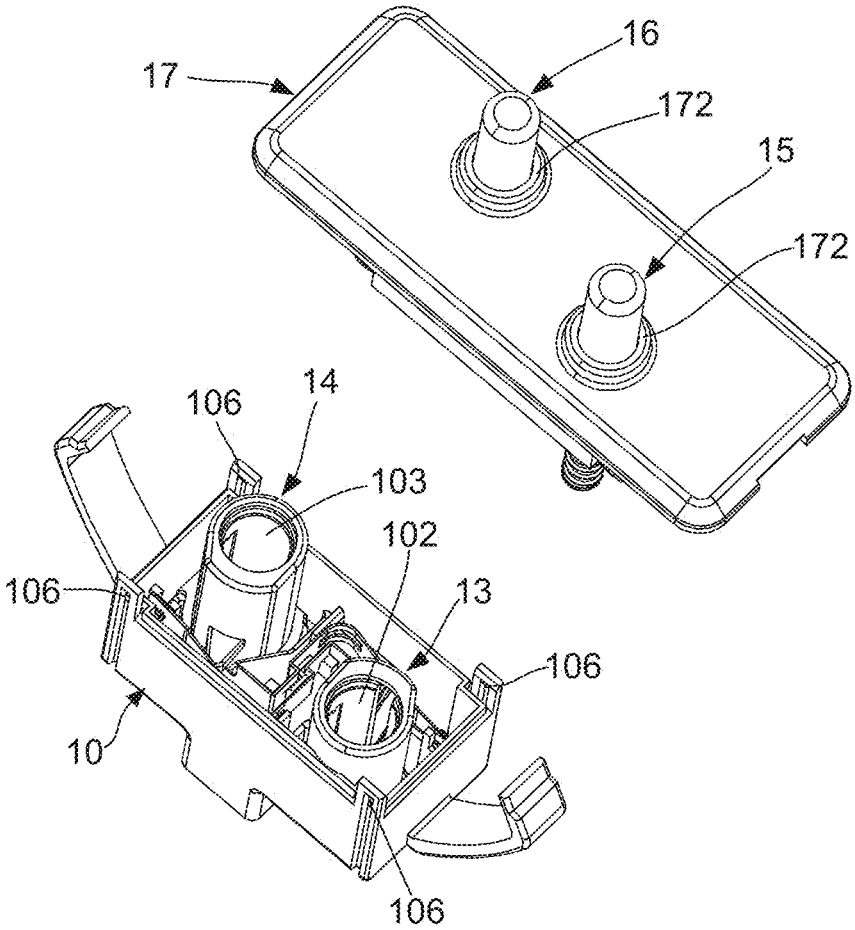
FIG. 10A shows a first stereo diagram for depicting the base and a cover of the dual-actuator switch.
Figure 10B:
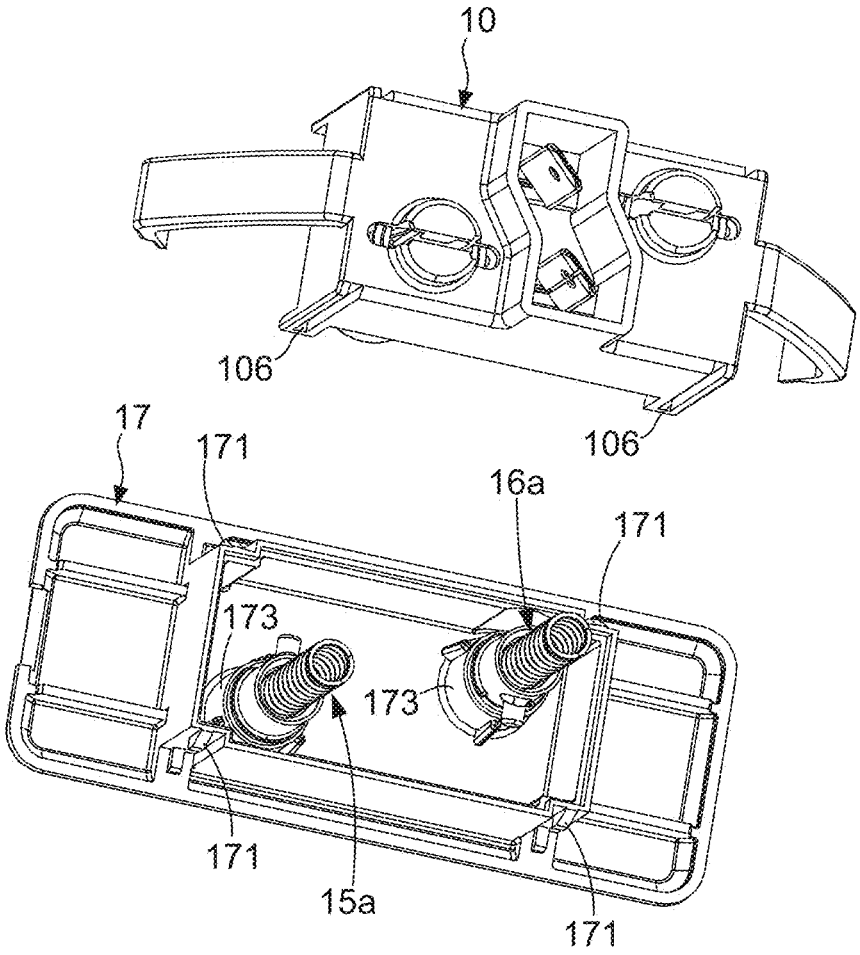
FIG. 10B shows a second stereo diagram for depicting the base and a cover of the dual-actuator switch.

Please continuously refer to FIG. 10A and FIG. 10B, there are provided two stereo diagrams for depicting the base and the cover of the dual-actuator switch. From FIG. 10A and FIG. 10B, it is found that a plurality of first locking members 106 are formed on side surfaces of the base 10. On the other hand, the cover 17 is further provided with a plurality of second locking member 171 for locking with the first locking member 106 when being assembled with the base 10. In addition, the cover 17 further comprises two third sleeve cylinders 173 respectively connecting with the two openings 172, wherein the first pressing portion extends out of the cover 17 by passing one of the two third sleeve cylinders 173 and one of the two openings 172, and the second pressing portion extends out of the cover 17 by passing the other one third sleeve cylinder 173 and the other one opening 172.

Therefore, through above descriptions, all constituting elements of the dual-actuator switch proposed by the present invention have been introduced completely and clearly; in summary, the present invention includes the advantages of:

(1) The present invention provides a dual-actuator switch 1, mainly comprising: a base 10, a first electrical connection member 11, a second electrical connection member 12, a first isolation sleeve cylinder 13, a second isolation sleeve cylinder 14, a first post-shaped actuator 15, a second post-shaped actuator 16, and a cover 17. By pressing the first post-shaped actuator 15 to drive the first isolation sleeve cylinder 13 to rotate, a first protrusion member 131 of the first isolation sleeve cylinder 13 is driven to prop the first electrical connection member 11, such that a first switching operation is carried out. By the same way, it is able to achieve a second switching operation through making a second protrusion member 141 of the second isolation sleeve cylinder 14 to prop the second electrical connection member 12 by pressing the second post-shaped actuator 16. It is worth noting that, the electrical connection members (11, 12) are isolated from the actuators (15, 16) by the isolation sleeve cylinders (13, 14) during the whole electrical switching procedures. As a result, ambient moisture is absolutely blocked from getting into the base 10 for infiltrating the electrical connection members (11, 12) during the up and/or down motion of the actuators (15, 16).

(2) Moreover, it is able to guarantee that the electrical terminals (111, 112, 121, 122) of the two electrical connection members (11, 12) are totally separated, by using the first protrusion member 131 (or second protrusion member 141) of the first isolation sleeve cylinder 13 (or second isolation sleeve cylinder 14) to prop the first electrical connection member 11 (or second electrical connection member 12). As a result, any shot circuits would not be produced between the electrical terminals (111, 112, 121, 122) of the two electrical connection members (11, 12).

The above description is made on embodiments of the present invention. However, the embodiments are not intended to limit scope of the present invention, and all equivalent implementations or alterations within the spirit of the present invention still fall within the scope of the present invention.

What is claimed is:

1. A dual-actuator switch, comprising:

a base, having an accommodating space;

a first electrical connection member, being disposed in the accommodating space and having a first electrical terminal and a second electrical terminal;

a second electrical connection member, being disposed in the accommodating space for facing the first electrical connection member, and having a third electrical terminal and a fourth electrical terminal for respectively connecting the first electrical terminal and the second electrical terminal;

a first isolation sleeve cylinder, being disposed in the accommodating space and provided with a first protrusion member on the outer wall thereof;

a second isolation sleeve cylinder, being disposed in the accommodating space and provided with a second protrusion member on the outer wall thereof;

a first return spring, being disposed in the first isolation sleeve cylinder;

a first post-shaped actuator, being disposed in the first isolation sleeve cylinder and connecting with the first return spring;

a second return spring, being disposed in the second isolation sleeve cylinder;

a second post-shaped actuator, being disposed in the second isolation sleeve cylinder and connecting with the second return spring; and a cover, being assembled with the base for sheltering the accommodating space, and having two openings;

wherein a first pressing portion of the first post-shaped actuator and a second pressing portion of the second post-shaped actuator are extended out of the cover via the two openings.

2. The dual-actuator switch of claim 1, wherein the base further comprises:

a first sleeve cylinder, being disposed in the accommodating space and provide with a first slide groove on the outer wall thereof; wherein the first isolation sleeve cylinder is disposed in the accommodating space by covering the first sleeve cylinder;

a second sleeve cylinder, being disposed in the accommodating space and provide with a second slide groove on the outer wall thereof; wherein the second isolation sleeve cylinder is disposed in the accommodating space by covering the second sleeve cylinder;

at least one first locking member, being formed on side surfaces of the base.

3. The dual-actuator switch of claim 2, wherein a first slant groove is formed on the inner wall of the first isolation sleeve cylinder; moreover, a second slant groove being formed on the inner wall of the second isolation sleeve cylinder.

4. The dual-actuator switch of claim 3, wherein the first post-shaped actuator further comprises:

a first position limiting flange, being formed on the outer wall of the first post-shaped actuator; and a first position limiting protrusion member, being formed on the outer wall of the first post-shaped actuator;

wherein after one pressing force is applying to the first pressing portion of the first post-shaped actuator, the first position limiting protrusion member sliding in the first slide groove and the first slant groove under the position limitation provided by the first position limiting flange and the inner wall of the first isolation sleeve cylinder; moreover, the first isolation sleeve cylinder being driven to rotate due to the sliding motion of the first position limiting protrusion member in the first slant groove;

wherein the rotation of the first isolation sleeve cylinder is limited in the case of that the first protrusion member props a first contact section of the first electrical connection member between the first electrical terminal and the second electrical terminal.

5. The dual-actuator switch of claim 4, wherein the second post-shaped actuator further comprises:

a second position limiting flange, being formed on the outer wall of the second post-shaped actuator; and a second position limiting protrusion member, being formed on the outer wall of the second post-shaped actuator;

wherein after one pressing force is applying to the second pressing portion of the second post-shaped actuator, the second position limiting protrusion member sliding in the second slide groove and the second slant groove under the position limitation provided by the second position limiting flange and the inner wall of the second isolation sleeve cylinder; moreover, the second isolation sleeve cylinder being driven to rotate due to the sliding motion of the second position limiting protrusion member in the second slant groove;

wherein the rotation of the second isolation sleeve cylinder is limited in the case of that the second protrusion member props a second contact section of the second electrical connection member between the third electrical terminal and the fourth electrical terminal.

6. The dual-actuator switch of claim 5, wherein the cover further comprises at least one second locking member for locking with the first locking member.

7. The dual-actuator switch of claim 5, wherein the cover 17 further comprises two third sleeve cylinders respectively connecting with the two openings; wherein the first pressing portion extends out of the cover by passing one of the two third sleeve cylinders and one of the two openings, and the second pressing portion extending out of the cover by passing the other one third sleeve cylinder and the other one opening.

* * * * *